United States Patent [19]

Daga

[11] Patent Number: 4,542,612

[45] Date of Patent: Sep. 24, 1985

[54] SYSTEM FOR FORMING STRUCTURAL CONCRETE

[76] Inventor: Andrew Daga, 122 Larchwood Ct., Collegeville, Pa. 19426

[21] Appl. No.: 621,724

[22] Filed: Jun. 18, 1984

Related U.S. Application Data

[62] Division of Ser. No. 348,192, Feb. 12, 1982.

[51] Int. Cl.[4] ..... C04B 5/30

[52] U.S. Cl. ..... 52/337; 52/320; 52/324; 52/327

[58] Field of Search ..... 52/323, 324, 319, 320, 52/325, 326, 333, 335, 327, 331, 332, 378, 414, 648, 337

[56] References Cited

U.S. PATENT DOCUMENTS

| | | | |
|---|---|---|---|
| 683,426 | 10/1901 | Balph | 52/331 |
| 1,033,413 | 7/1912 | Kahn . | |
| 1,073,906 | 9/1913 | Kahn . | |
| 1,095,204 | 5/1914 | Golding . | |
| 1,140,571 | 5/1915 | Burcharitz | 52/337 |
| 1,182,355 | 5/1916 | Crane . | |
| 1,239,503 | 9/1917 | Merrick . | |
| 1,307,031 | 6/1919 | Allbright | 52/337 |
| 1,338,567 | 4/1920 | Flynn . | |
| 1,353,373 | 9/1920 | Allbright . | |
| 1,729,612 | 10/1929 | Goldsmith | 52/320 |
| 1,860,616 | 5/1932 | Kahn | 52/331 |
| 1,941,211 | 12/1933 | Inglee | 72/66 |
| 1,953,138 | 4/1934 | Sylvester | 52/326 |
| 3,218,767 | 11/1965 | Stark | 52/320 |
| 3,364,633 | 1/1968 | Polo | 52/648 |
| 3,372,523 | 3/1968 | Hall, Jr. | 52/699 |
| 3,382,637 | 5/1968 | Longinotti . | |
| 3,407,560 | 10/1968 | Bauman | 52/648 |
| 3,640,040 | 2/1972 | MacLean, III et al. | 52/337 |
| 3,829,999 | 8/1974 | Bernstein | 52/648 |
| 4,201,023 | 5/1980 | Jungbluth | 52/334 |

FOREIGN PATENT DOCUMENTS

| | | | |
|---|---|---|---|
| 122321 | 4/1931 | Austria | 52/329 |
| 115352 | 6/1942 | Austria | 52/335 |
| 529030 | 12/1920 | France | 52/329 |
| 1069577 | 7/1954 | France | 52/323 |
| 505920 | 12/1954 | Italy | 52/335 |
| 7707404 | 6/1977 | Sweden | 52/320 |
| 20704 | of 1908 | United Kingdom | 52/324 |
| 399997 | 10/1933 | United Kingdom | 52/329 |

*Primary Examiner*—Henry E. Raduazo
*Attorney, Agent, or Firm*—Anthony S. Volpe

[57] ABSTRACT

A system for forming concrete structural elements including a plurality of runners forming a spaced array; a plurality of supports extending upwardly from and connecting intersecting runners; and a plurality of coffer plates secured in position over the supports by a plurality of anchor nuts capable of interacting with the concrete poured to form the structural element. The coffer plates initially act as a mold for the structural element being formed. Thereafter, the array of runners and supports are used to suspend finishing components (plumbing lines, eletrical conduit, electrical wiring and fixtures, ceilings, non-load-bearing walls, etc.) from the structural element without requiring alteration of the concrete forming the structural element.

39 Claims, 24 Drawing Figures

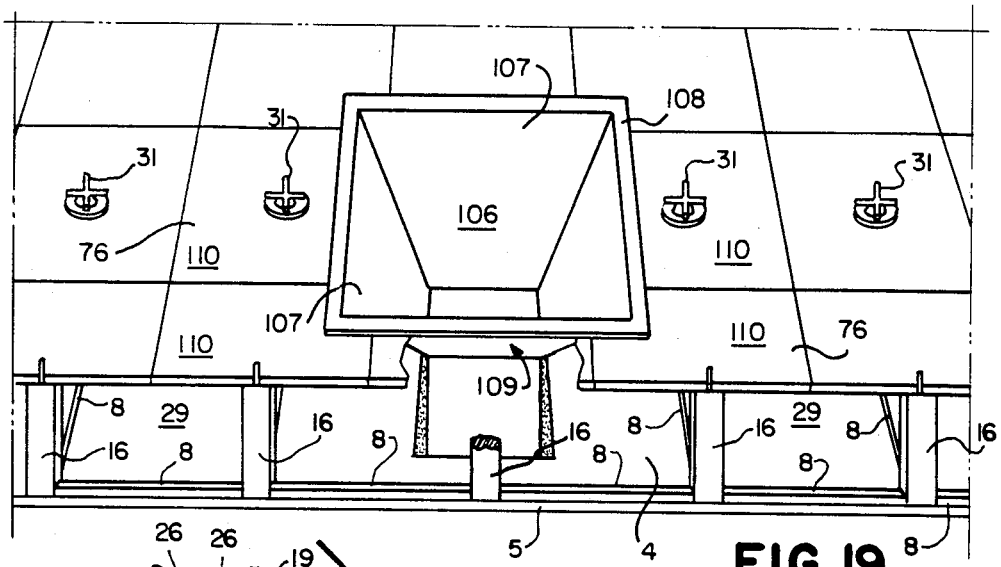
FIG. 19
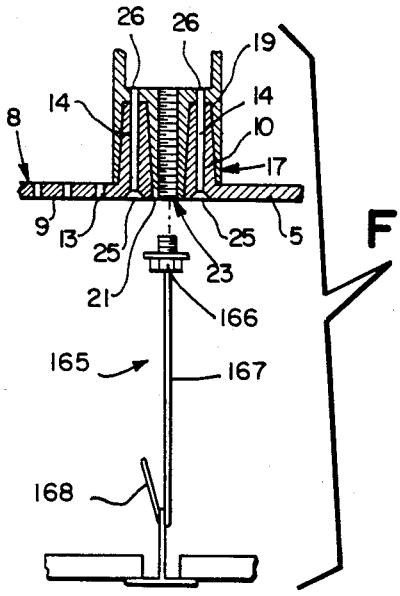
FIG. 20
FIG. 21
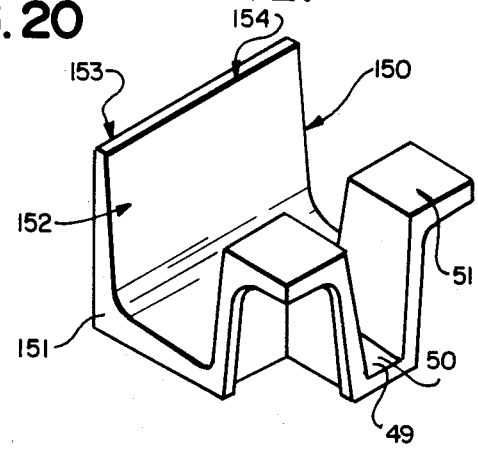
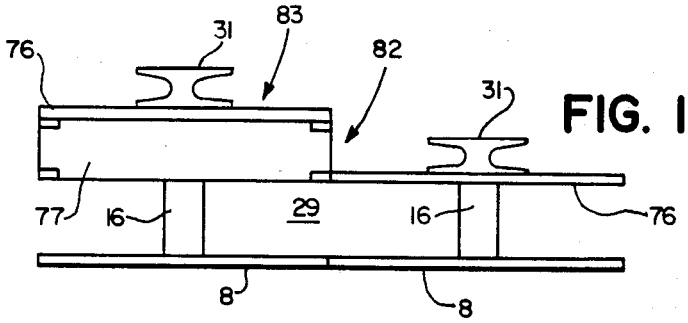
FIG. 14

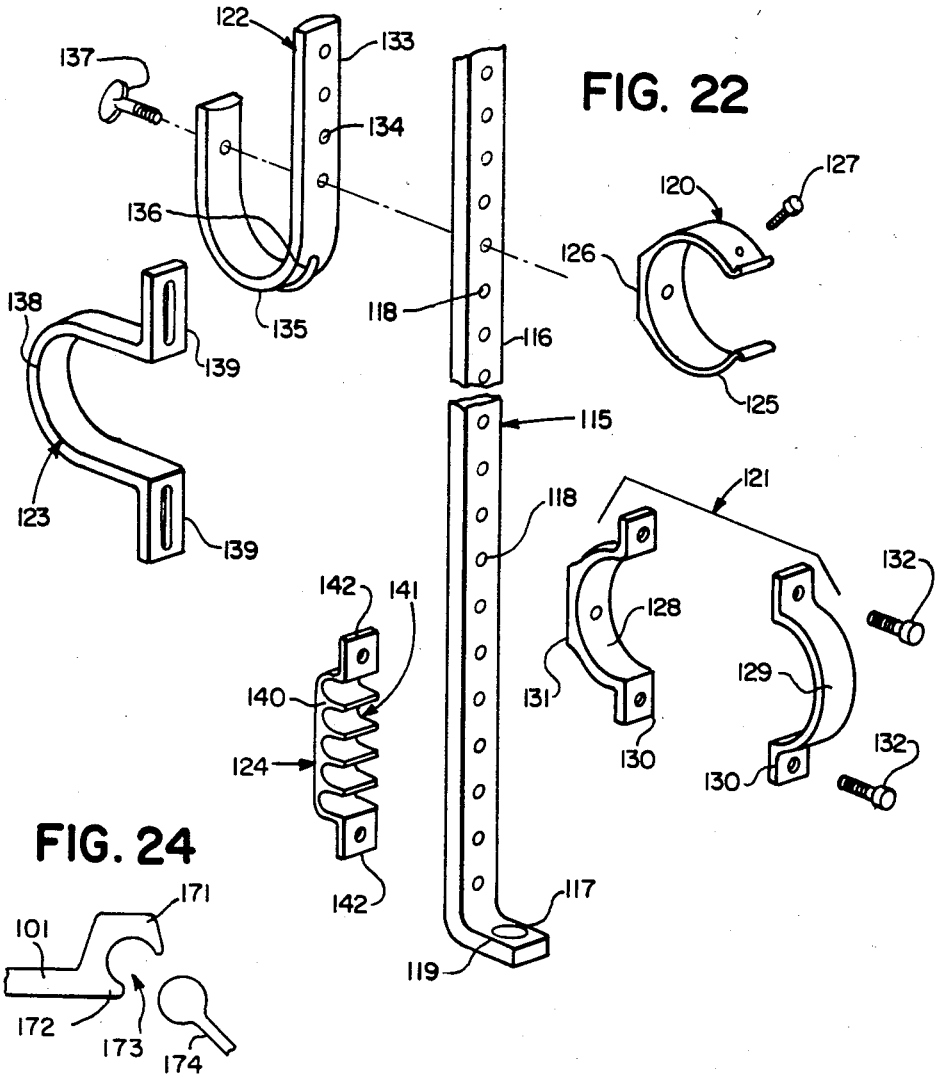
FIG. 22
FIG. 24
FIG. 23
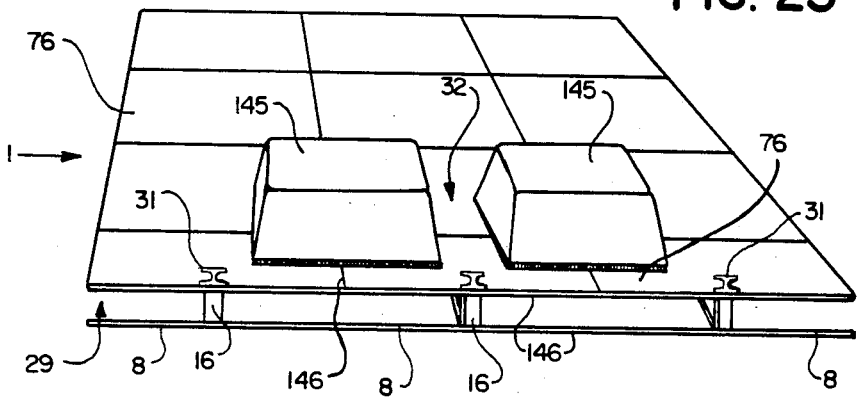

SYSTEM FOR FORMING STRUCTURAL CONCRETE

This is a divisional of application Ser. No. 348,192, filed Feb. 12, 1982.

BACKGROUND OF THE INVENTION

The present invention relates generally to formed-in-place concrete constructions, and more particularly, to a system which can be used to facilitate the construction of various types of structural elements using this technique.

One widely accepted technique which has been used to construct buildings or the like involves the use of reinforced concrete as the structural media. In general, this includes the construction of concrete forms in a desired shape, such concrete generally being reinforced by a metal framework contained within each form. By proper assembly of the forms, and by proper placement of the reinforcing framework, a variety of different constructions may be provided, such a flat slab, flat plate, one and two-way solid slab, one way joist and waffle flat plate constructions.

Irrespective of the construction desired in a particular application, the following technique is generally utilized to form such structures. First, a falsework is erected which serves as a support for the forms which are to be assembled to shape the structural element being formed. Such falseworks generally take the form of a scaffolding system or frame which is used to determine the general location of the structural element being formed. Wood joists and plywood decking, as indicated, are then placed over the scaffolding to form a temporary floor upon which the forms which will be used to shape the structural element will be assembled. After erection of the falsework, a measurement procedure is performed which marks out the location of the forms, often referred to as coffers, which will be used in the formation of the structural element. After the measurement procedure, the forms or coffers are then installed in position on the falsework and secured in place. Any perimeter barrier forms which are required are also installed at this time, resulting in the formation of a network of cavities capable of subsequently receiving poured concrete. After installation of the forms or coffers on the falsework, any metal reinforcing rods which are to be used in conjunction with the construction are installed within the concrete receiving cavities defined by the assembled forms or coffers. Also at this time, any small-gauge wires or pipes which may be required for a particular application are installed, so that they may become embedded in the concrete after it has been poured. After this assembly is completed, the concrete is poured into the concrete receiving cavities, and is allowed to surround the reinforcing rods or other structures which have been located within the concrete receiving cavities. The concrete is then allowed to cure in place. After curing, the falsework is removed from below the structural element which has been formed by removing the scaffolding, wood joists and plywood decking which previously served as a temporary support for the structural element.

After performing these steps, the structural element which has been formed must be finished to complete the building under construction. For example, it is often necessary to provide the building with plumbing lines and electrical conduit, to properly service the building.

Additional wiring and fixtures must be provided for any lighting, fans, air conditioning, telephones, and the like, which are to be provided. Lastly, it is often necessary to provide some means for receiving a finished ceiling and/or non-load-bearing partitions beneath the structural element which has been formed, to enclose the building and prepare it for occupancy. Many times, special consideration must be given to unusually heavy components which which must be suspended from the ceiling, still further complicating matters.

To provide these functions, it is necessary to adapt the structural element which has been formed to receive the components previously described. Generally this is accomplished by attaching suitable anchors to the structural element, which anchors are capable of supporting the foregoing components in position as required. Often, this is accomplished using powder-actuated fasteners which are installed using a special tool or gun. To do so, blank shells loaded within the gun are used to inject nail-like anchors into the concrete. These anchors are then used to support components from the structural element. However, the special guns which are needed for this are expensive to purchase and are rather heavy, making their use difficult. Moreover, such devices are extremely dangerous and noisy in use. An alternative method of installation involves boring holes in the concrete element and, using appropriate reinforcements, bolting the component or component hanger directly to the structural element. Such a technique, while providing satisfactory results, is extremely labor intensive and time consuming. In addition to the labor costs involved, it is also necessary to provide equipment which is capable of boring the necessary holes in the structural element formed. This equipment is also expensive, particularly since the drill bits which are used in conjunction with such equipment have relatively short useful lives.

It may therefore be seen that a substantial amount of time and effort must be expended before finishing materials and components can be applied to a structural element which has been formed. It is therefore desirable to eliminate as many installation steps as is possible, resulting in attendant savings in time and labor costs.

SUMMARY OF THE INVENTION

In accordance with the present invention, a system is provided which can be used in conjunction with techniques currently used in the construction of reinforced concrete structural elements, but which eliminates the foregoing disadvantages. To this end, a system is provided which generally includes a network of cooperating elements which can be used in place of those forms and coffers which are presently used to form such structural elements.

Initially, a falsework is erected in the conventional manner, to provide a temporary structure upon which the system of the present invention may be located. After erection of the falsework, a network of runners or pedestal feet are placed upon the decking of the falsework in a regular network or pattern. Intersections of the network of pedestal feet are interconnected by supports or pedestals which engage and secure the pedestal feet in position, developing a network of pedestals positioned over the decking of the falsework. Any forms or coffers which are to be used in forming the structural element under construction are then positioned over the pedestals in the desired pattern. A variety of different forms and coffers may be combined as needed, to create any of a number of desired structural elements. Lastly, the forms or coffers are attached to the pedestals using an anchor nut, producing a series of concrete receiving cavities which, in appearance, resemble the concrete receiving cavities created using presently available construction techniques.

After formation of the concrete receiving cavities, any appropriate reinforcing rods or other structures may be placed within the concrete receiving cavities, to form a reinforcing network in the conventional manner. Thereafter, concrete is poured into the concrete receiving cavities, and around any reinforcing structures provided, to form the structural element desired. The concrete is then allowed to cure in the conventional manner. After the concrete has cured, the falsework is removed, leaving the structural element in place.

After removal of the falsework, the network of pedestals and pedestal feet which were previously used to support the forms or coffers which shaped the structural element are now supported in position by the finished structural element. The forms or coffers are allowed to remain in position beneath the poured concrete, the anchor nuts which had been used to attach the forms or coffers to the pedestals now being firmly embedded in the poured concrete. In this manner, the same network of pedestals and pedestal feet which was originally used to support the forms or coffers used to shape the structural element is now firmly supported in position beneath the finished structural element, providing a network which serves as a basis for finishing the structure being created without having to alter or work the structural element as was previously required.

For example, the network of pedestal feet serves as a convenient means for supporting plumbing lines, electrical conduits or duct work in position beneath the structural element which has been formed. The pedestal feet also serve as a convenient means for directly engaging any lights, fans or other ceiling members which are required to form a finished ceiling, or as a means for engaging non-load-bearing partitions which are needed to finish the interior of the structure. All of these components may be installed immediately, without first having to provide the structural element with separate anchors capable of supporting such components in position. Since a supportive network has already been provided, the labor which was previously required to install means for supporting such components is eliminated. As an added advantage, such components may be installed "from above", before the forms or coffers are placed over the pedestals and pedestal feet, in addition to "from below", after the structural element has been formed, providing a versatile means for installing such components.

Accordingly, it is a primary object of the present invention to provide a system for conveniently forming structural concrete elements.

It is also an object of the present invention to provide a system for forming a structural concrete element which also assists in finishing the resulting structure without requiring alteration of the structural element after it has been formed.

It is also an object of the present invention to provide a system for forming a structural concrete element which is modular in nature, and which therefore can be used to create a variety of different concrete form types.

It is also an object of the present invention to provide a system for forming a structural concrete element which is modular, and which is therefore adaptable for use with a variety of different finishing components.

It is also an object of the present invention to provide a system for forming a structural concrete element which is easy to use and which significantly reduces the amount of labor which is necessary to finish a structure comprising the structural element formed.

It is also an object of the present invention to provide a system for forming a structural concrete element which is compatable with presently existing, recognized building construction techniques, yet which provides all of the foregoing advantages.

These and other objects will become apparent from the following detailed description, taken in conjunction with the following illustrations.

DESCRIPTION OF THE DRAWINGS

FIG. 14 is a cross-sectional view of the system shown in FIG. 13, taken along line 14—14.

FIG. 19 is a partial, perspective view illustrating use of the system of the prevent invention to create a capital form, portions being broken away to illustrate internal construction detail.

FIG. 20 is a partial, cross-sectional view illustrating use of a conventional suspended ceiling system in conjunction with the system of the present invention.

FIG. 21 is an axonometric view of an alternative embodiment coffer plate which can be used to form a waffle flat plate structural element with an integral barrier form.

FIG. 22 is an exploded, isometric view illustrating various mounting brackets which can be used in conjunction with the system of the present invention.

FIG. 23 is a partial, perspective view showing use of the system of the present invention in conjunction with conventional, blind coffers.

FIG. 24 is a partial, cross-sectional view of a ceiling member and a diffuser engaged by the ceiling member.

In the several views provided, like reference numerals denote similar structure.

DETAILED DESCRIPTION OF THE PREFERRED EMBODIMENT

Although specific forms of the invention have been selected for illustration and the following description is drawn in specific terms for the purpose of describing these forms of the invention, this description is not intended to limit the scope of the invention which is defined in the appended claims.

Figure 1:
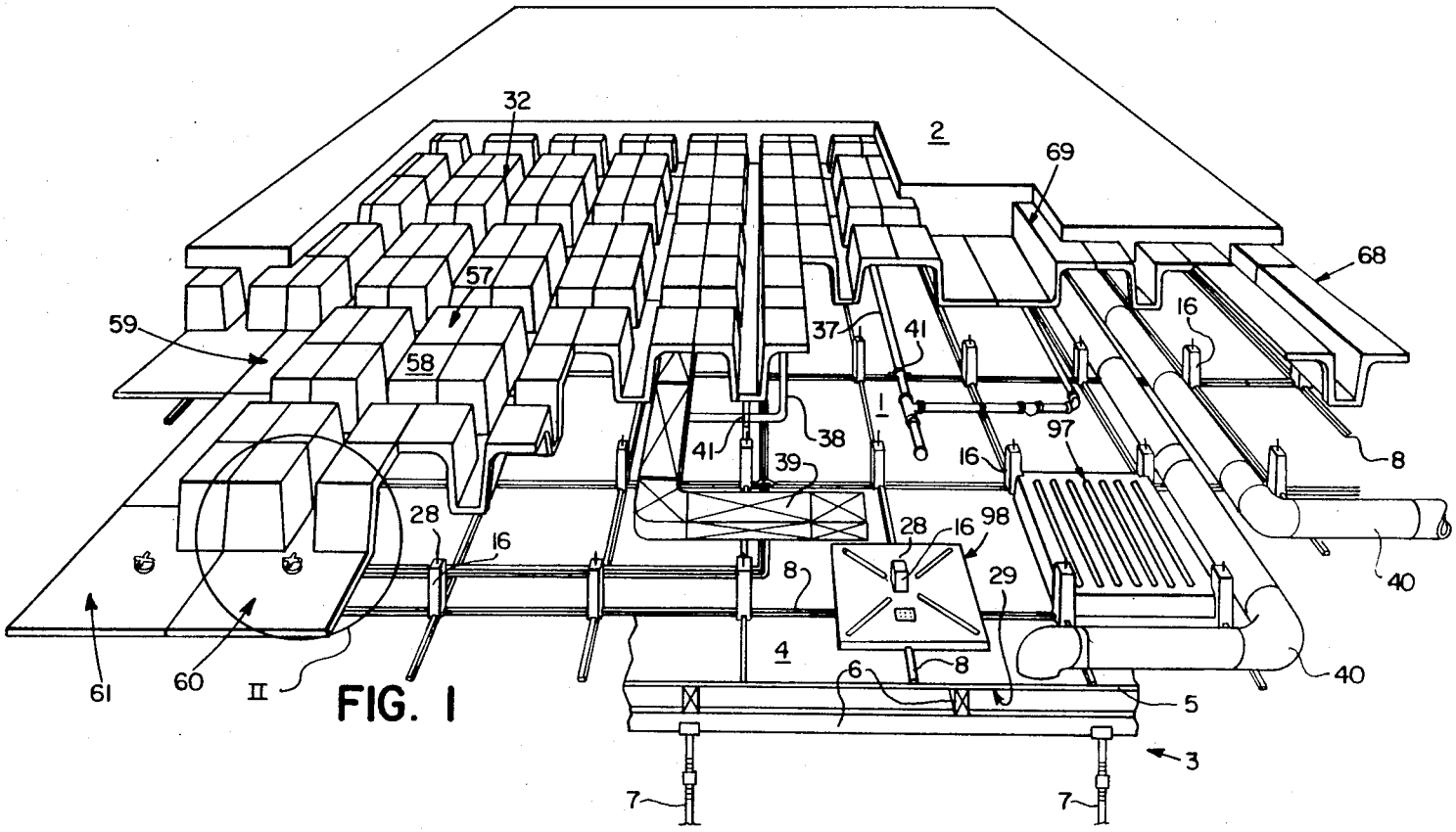
FIG. 1 is a fragmentary, perspective view illustrating use of the system of the present invention, portions of which have been broken away to show internal construction detail.

The system 1 of the present invention generally involves the assembly of a number of discrete components to form a pattern which corresponds to the concrete shape 2 which is to be formed. As previously discussed, it is conventional for these components to be assembled on a falsework 3 which forms a platform or surface upon which assembly of the various elements comprising the system may take place. Portions of a conventional falsework 3 are illustrated in FIG. 1 and include a falsework platform 4 which comprises a plurality of juxtaposed plywood sheets 5 supported in position by joists 6 positioned beneath the plywood sheets 5 as shown. These joists 6 are then maintained in position by an appropriate scaffolding system, such as the jack supports 7 shown. Of course, a variety of other techniques may be used to construct the falsework 3, the structure illustrated in FIG. 1 only representing one such way in which this can be accomplished. Irrespective of the falsework 3 which is used, a platform 4 is provided upon which the system 1 of the present invention may be assembled.

In assembling the system 1, a plurality of pedestal feet 8 are positioned on top of the platform 4, preferably forming a regular pattern. The pattern illustrated in FIG. 1 results in a generally square lattice work, which is generally preferred. However, other orientations and shapes may also be formed if desired.

Figure 2:
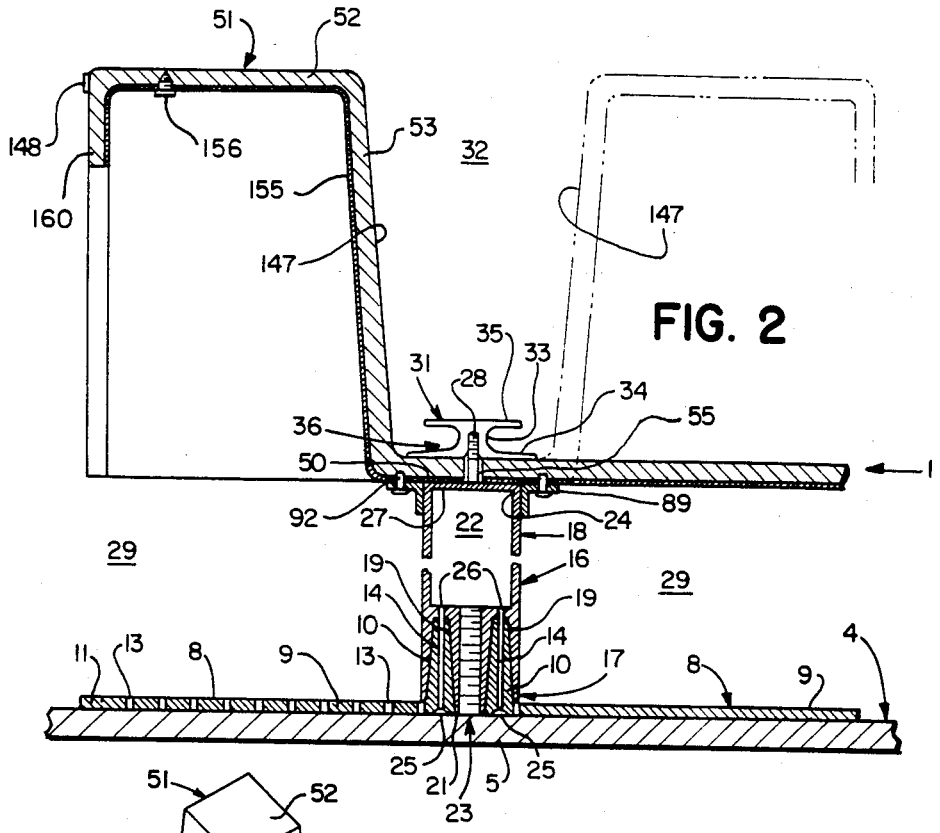
FIG. 2 is a partial, cross-sectional view of the area indicated in FIG. 1 by the reference numeral II.

In their preferred embodiment, each of the pedestal feet 8 generally comprises a longitudinal segment 9, one end of which is provided with a tapered portion 10 and the other end of which is provided with either a tenon 11 or a slot 12, for a purpose which will be more fully described below. As is best illustrated in FIG. 2, the longitudinal segment 9 of each of the pedestal feet 8 is provided with a series of apertures 13. To facilitate subsequent operations, it is preferred that these apertures 13 be regularly spaced across the segment 9, however, other spacings may also be provided. The apertures 13 are preferably threaded to accept corresponding hardware, however, the apertures 13 may also be unthreaded if desired. The tapered portion 10 generally forms a truncated pyramid and includes a centrally disposed aperture 14, the purpose of which will be more fully described below. In general, the pedestal feet 8 may be formed of a variety of materials, however preferred materials include cast metal or molded fiberglass-reinforced plastic. Although such materials are preferred, the pedestal feet 8 may also be formed of other materials which assist in maximizing the stability of the system 1 after the concrete has been poured, and in assuring proper loading strength both during pouring of the concrete, and later, after the falsework 3 has been removed.

Referring to FIGS. 1 and 2, it may be seen that the pedestal feet 8 are arranged in a regular pattern so that the tenon 11 of one of the pedestal feet 8 is engaged by a corresponding slot 12 of one of the adjacent pedestal feet 8. To facilitate this interconnection, it is preferred that the tenon 11 diverge toward its outermost tip, and that the slot 12 be provided with a corresponding converging configuration capable of receiving the diverging tenon 11. This interconnection may be maintained by frictional forces, or preferably, using a set screw 15 or other appropriate structure. Use of the tenon 11 and slot 12 is preferred to promote the modular nature of the system 1, and to optimize interchangability and adaptability of the elements provided to a variety of different applications. However, use of the tenon 11 and slot 12 is not essential to the present invention, since other interlocking arrangements may also be used. For example, it is also possible to provide pedestal feet having opposing tapered portions 10 to form the assembly, if desired. Alternatively, each of the pedestal feet 8 may be provided with a slot 12, and a butterfly connector (not shown) having two opposing tenon portions may be used to engage the slots of the pedestal feet 8 during assembly. Other variations are also possible.

Figure 4:
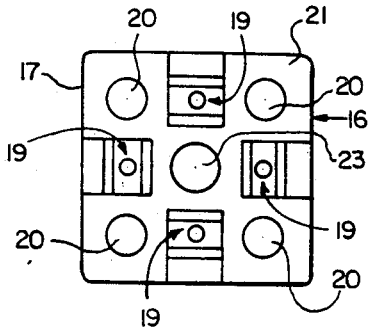
FIG. 4 is a bottom, plan view of a pedestal of the type shown in FIG. 3.
Figure 3:
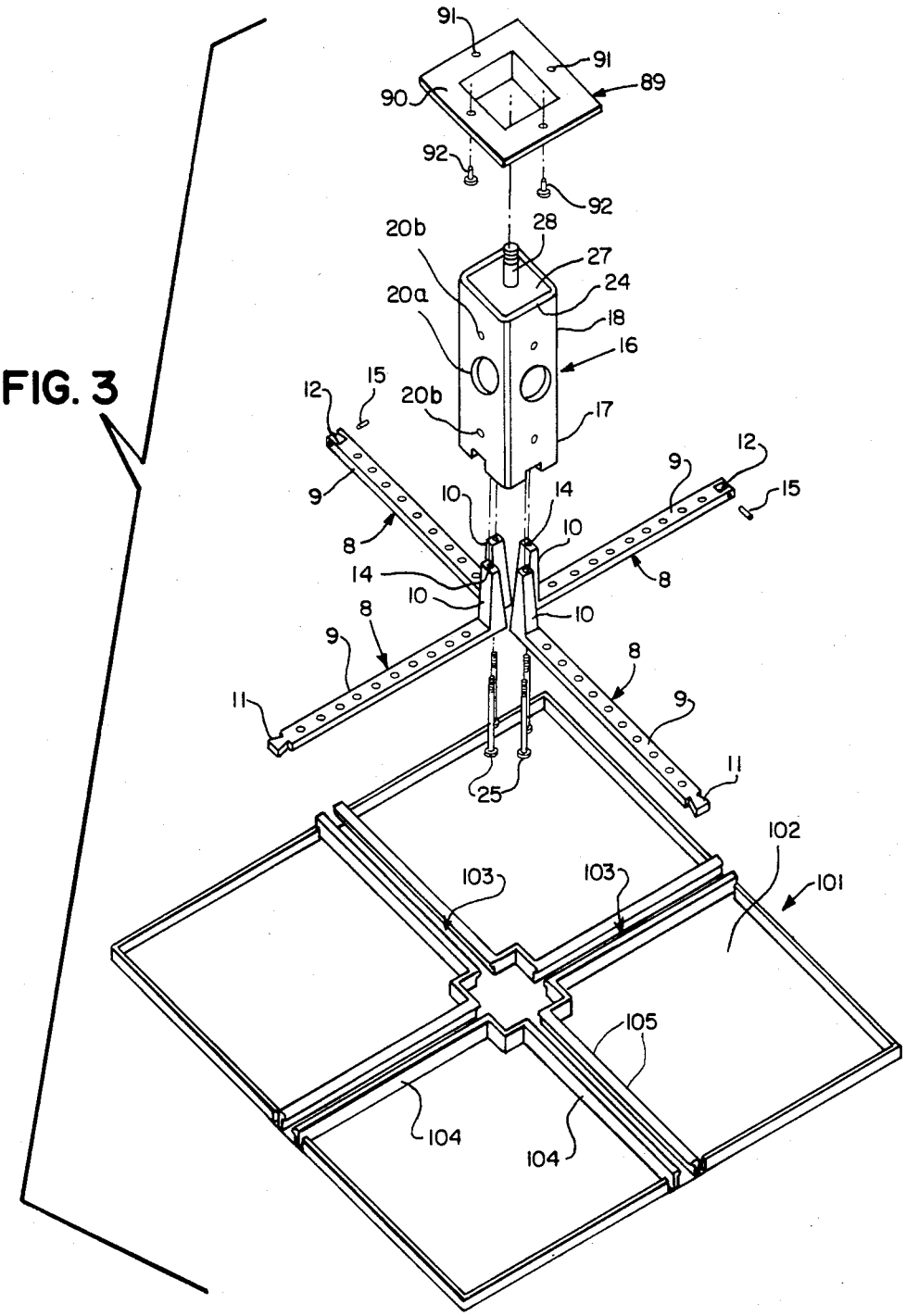
FIG. 3 is an exploded, axonometric view of the pedestal structure shown in FIG. 2.

As illustrated in FIGS. 1–3, a series of pedestals 16 engage the tapered portions 10 of intersecting pedestal feet 8. These pedestals 16 are preferably formed of a die-cast metal, however, other materials may also be used. As is best illustrated in FIGS. 3 and 4, each pedestal 16 generally includes a base portion 17 and a pylon portion 18.

The base portion 17 is preferably square in cross-section and includes a series of apertures. A first group of apertures 19 define a tapered recess having a configuration which substantially corresponds to that of the tapered portion 10 of the pedestal feet 8. It is preferred that these elements closely correspond to promote a secure fit between components during assembly. A second group of apertures 20 are provided which extend from the bottom 21 of the base 17, through the base 17, to a cavity 22 defined within the pylon portion 18 of the pedestal 16. These apertures 20 are primarily used to permit the passage of various components from the exterior of a pedestal 16 to the interior cavity 22, such as electrical wiring and the like. A third type of aperture 23 which is provided is substantially centrally disposed within the base portion 17, and is preferably threaded. The aperture 23 is primarily used as a means for hanging components from the pedestal 16, as will be more fully described below.

The pylon portion 18 forms the upper part of the pedestal 16 and preferably has a cross-sectional shape which substantially corresponds to that of the base portion 17. The pylon portion 18 is variable in length, to accomodate different applications, and preferably includes several additional apertures **20*a* and 20*b*. The apertures 20*a* facilitate access to the cavity 22, and are advantageously used in conjunction with the apertures 20 to pass electrical wiring through the pedestals 16 as needed. The apertures 20*b* are preferably threaded, and are advantageously used to facilitate the attachment of components and component brackets to the pedestals 16**, as will be more fully described below.

The upper end of the pylon portion 18 terminates at an opening 24 which exposes the cavity 22. The opening of the pylon 24 is provided with an appropriate attachment means, such as the plate 27 and stud 28 illustrated. The plate 27 preferably fully encloses the opening 24 of the pylon portion 18, and the stud 28 preferably projects outwardly from the center of the plate 27 as shown. The plate 27 and stud 28 may be attached over the opening 24 of the pedestal 16 at the installation site, however, preferably, these elements are pre-assembled to facilitate their use. A variety of techniques may be used to form this assembly, examples including the use of adhesives, soldering, welding, etc.

During assembly of the system 1, the apertures 19 are engaged by the tapered portions 10 of intersecting pedestal feet 8, and conventional hardware such as the flat-head machine screws 25 illustrated are used to connect the pedestal feet 8 to the pedestals 16. To do so, the screws 25 are extended through the aperture 14 of the tapered portion 10 to the base portion 17, which is provided with appropriately threaded apertures 26 capable of receiving the screws 25. In this manner, structural integrity is provided between the network of pedestal feet 8 and the pedestals 16 which interconnect them.

Clearly, the pedestals 16 and pedestal feet 8 may be assembled in any desired order to form the array required for a particular application. However, a particularly convenient manner of assembly includes attaching four pedestal feet 8 to a pedestal 16, forming a sub-assembly, and then placing such sub-assemblies on the platform 4 of the falsework 3 so that respective tenons 11 and slots 12 are brought into engagement as previously decribed.

Irrespective of the assembly techniques used, the assembled combination of pedestal feet 8 and pedestals 16 defines a plane which is raised from the platform 4 and which is capable of accepting the forms or coffer plates which will be used to form the structural element being constructed. A variety of different types of coffer plates may be used for this purpose, the shape of the structural element being constructed being determined by the shape of the coffer plates used. Several types of coffer plates which may be used for this purpose will be described below.

Irrespective of the type of coffer plate used, a substantially centrally disposed aperture 55 is provided which is capable of engaging the stud 28 of a pedestal 16. During assembly, the aperture 55 of each coffer plate is appropriately engaged by one of the studs 28 of the pedestals 16, and an anchor nut 31 is then attached over the stud 28 to retain the coffer plate in position over the pedestal 16 to which it is attached. By locating an appropriate network of coffer plates over the network of pedestals 16 provided, a continuous, concrete receiving cavity 32 is formed which corresponds to the type of cavity which is used in conjunction with conventional construction techniques. The remainder of the construction process proceeds in accordance with conventional and recognized building practices. For example, reinforcing rods may be positioned withing the concrete receiving cavity 32, as desired. Liquid concrete is then poured into the concrete receiving cavity 32, surrounding the reinforcing rods which are used and forming the concrete shape 2 desired.

As previously described, each coffer plate is retained to a corresponding pedestal 16 using an anchor nut 31. The anchor nut 31 preferably includes a centrally disposed core 33 which is capable of receiving the stud 28; a bearing surface 34 associated with the lowermost end of the core 33, which serves to properly secure the coffer plate to the pedestal 16 during the assembly process; and an anchor portion 35 associated with the opposing end of the core 33, which expands outwardly from the core to define a concrete engaging cavity 36. The bearing surface 34 and the anchor portion 35 may comprise either a continuous, flat plate which expands radially outwardly from the core 33, or may comprise a plurality of rod or plate portions extending radially outwardly from the core 33. In either case, the bearing surface 34 securely maintains the coffer plate in position during assembly of the system 1, and during pouring of the concrete. As the concrete is poured, the cavity 36 defined by the anchor position 35 is filled, securely encasing the anchor nut 31 within the structural element being formed. Additional structural integrity between the anchor nut 31 and the structural element being formed may be obtained by attaching the reinforcing rods which are located within the cavity 32 directly to the anchor nuts 31, using any of a variety of recognized techniques.

After the liquid concrete has been poured into the concrete receiving cavity 32, and the concrete has appropriately cured, the concrete shape 2 which forms the structural element being produced is completed, and the falsework 3 can then be removed. Removal of the falsework 3 is readily accomplished by removing the jack supports 7 from beneath the platform 4, thereby releasing the assembly in the a conventional manner. However, in using the system 1 of the present invention, the network of pedestal feet 8 and pedestals 16 remains secured to the structural element formed, primarily due to interaction between the anchor nuts 31 and the concrete which forms the structural element. Since the anchor nuts 31 are encased within concrete, substantial forces may be applied to the pedestals 16, if desired.

After removing the falsework 3, the system 1 which had been used to form the concrete shape 2 now serves as a framework which can be used in completing the finished structure. The space 29 defined between the concrete shape 2 and the pedestal feet 8 serves to receive any components which are to be used in finishing the structure, such as plumbing 37, electrical conduit 38 and ductwork 39, 40 using either the conventional attachment brackets 41 shown in FIG. 1, or using attachment brackets which are particularly adapted for use with the system 1, which will be more fully described below. These components are readily attached directly to the system 1, without having to first prepare or modify the structural element which has been formed.

In many applications, the components 37, 38, 39, 40 will be assembled from beneath the structural element, after the structural element has been formed, as is coventional. However, the system 1 of the present invention also permits these components to be assembled prior to forming the structural element, from above. This may be done by placing the components 37, 38, 39, 40 in position, as desired, after assembly of the network of pedestal feet 8 and pedestals 16, but prior to positioning the coffer plates over the pedastals 16 as previously described. Thereafter, the coffer plates would then be positioned over the pedestals 16, and the remainder of the construction process would proceed as previously described. Proper positioning of the components 37, 38, 39, 40 is readily assured since the network of pedestal feed 8 and pedestals 16 defines a regular latticework upon which the components 37, 38, 39, 40 may be placed. Installation of the components 37, 38, 39, 40 is facilitated since these components need only be laid upon the falsework 3 and the network of pedestal feet 8 and pedestals 16 from above, rather the requiring these components to be raised and suspended from below while they are being attached to the structural element formed.

It may therefore be seen that the foregoing system serves well in the construction of a variety of different structural shapes. Clearly, the shape which is to be constructed is primarily defined by the manner in which the coffer plates are assembed to form the concrete receiving cavity 32. Some particularly useful coffer plate configurations which may be used to define the shape of the structural element being formed are illustrated in FIGS. 5 to 12.

Figure 5:
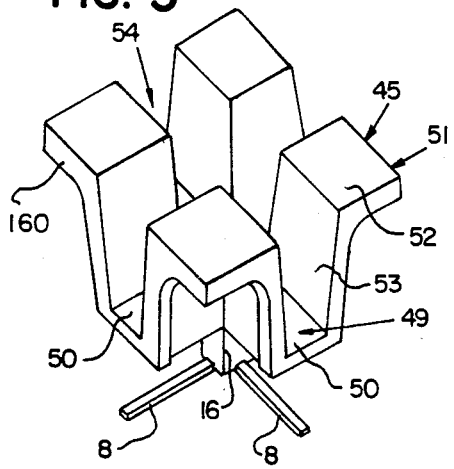

FIGS. 5 to 8 illustrate coffer plates 45, 46, 47, 48 which can be combined in various ways to form a waffle flat plate construction. The coffer plate 45 illustrated in FIG. 5 represents the basic building block for such a construction. As shown, the base 49 of the coffer plate 45 generally includes two substantially flat, intersecting strips 50 which combine to define a central region in the coffer plate 45. Each corner of the coffer plate 45 is provided with a raised portion 51 having an upper portion 52 which is substantially flat, and a pair of walls 53 extending between the upper portion 52 and the base 49 of the coffer plate 45. In this manner, two cavities 54 are formed which intersect at the center of the coffer plate 45. The perimeter of the coffer plate 45 is preferably provided with a depending flange 160, as shown, for increased structural integrity and to facilitate alignment during assembly. As is readily understood, the dimensions of the various elements comprising the coffer plate 45 may be freely varied to meet a particular construction need. For example, the width of the cavities 54 may be varied to alter the width of the structural element being formed. The height of the walls 533 may be varied, as may be the size of the upper portions 52, to alter the thickness and shape of the structural element being formed. Other alterations may also be provided as needed.

Figure 8:
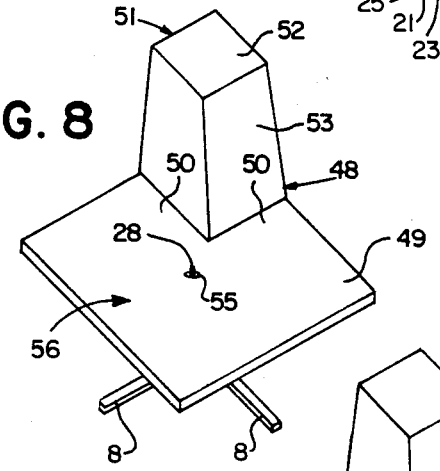
FIGS. 5 to 8 illustrate forms or coffer plates which can be used to form a waffle flat plate structural element.
Figure 7:
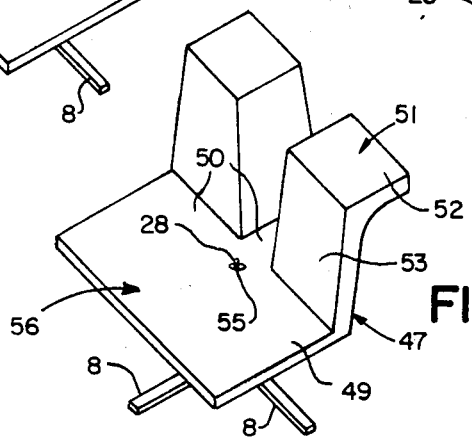
Figure 6:
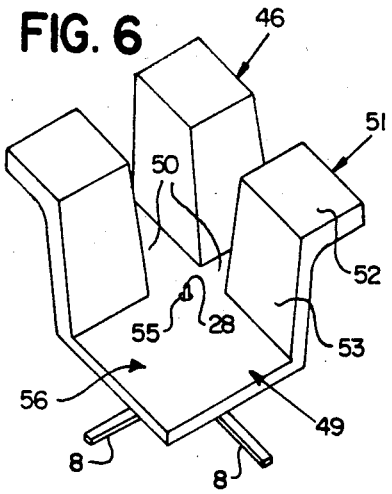

The coffer plates 46, 47, 48 illustrated in FIGS. 6, 7 and 8, respectively, are provided with structural features which are substantially similar in purpose to the structural features of the coffer plate 45. However, in each case, one or more of the raised portions 51 have been removed, and a substantially flat portion 56 has been substituted in their place. Preferably, the flat portions 56 are substantially coextensive with the strips 50, providing a coffer plate having either one, two, or three raised portions 51, and the remainder of which is substantially flat, for purposes which will be described below. Again, the configuration of the structural features comprising the coffer plates 46, 47, 48 may be freely varied as needed.

As shown in FIGS. 5 to 8, the base 49 of each coffer plate 45, 46, 47, 48 includes an aperture 55. The aperture 55 is preferably substantially centrally disposed, at the intersection of the strips 50, and extends fully through the base 49. The aperture 55 is therefore suited for engagement by the stud 28 of a pedestal 16 to which the coffer plate is to be attached. The anchor nut 31 is then used to secure the coffer plate to the pedestal 16 as previously described, which also positions the anchor nut 31 within the cavities 54 of the coffer plate used.

The coffer plates 45, 46, 47, 48 may be formed of a variety of different materials. For example, stamped metal forms or molded fiberglass constructions may be used. However, the use of a composite wood fiber material comprising wood fibers disposed in a resinous or cementitious matrix and molded under high pressure is preferred, due to its low cost and ease of use, and since such materials permit the inner walls 147 of the coffer plates to be provided with a rough surface texture capable of providing a bond between the coffer plates used and the structural element formed. Combinations of these materials may also be used. For example, a fiberglass or composite wood fiber form may be provided with a metal liner 155 for increased strength and support, if desired. The metal liner 155, if used, also serves as a vapor barrier and to assist in fire protection. As a further advantage, screws 156 may be threadingly attached to the metal liner 155, providing added means for suspending components from the system 1 of the present invention. Irrespective of the material used to form the coffer plates 45, 46, 47, 48, the use of a pile strip 148 which extends about the perimeter of the coffer plate is preferred to provide a gasket which seals against the seepage of liquid concrete through the seams which are developed between adjacent coffer plates. Similar construction materials, as well as the pile strips 148, may be used in conjunction with other coffer plate configurations, used to form other types of structural elements, if desired.

Referring now to FIG. 1, one manner in which the coffer plates 45, 46, 47, 48 may be assembled to form a waffle flat plate construction is shown. As illustrated at 57, a plurality of coffer plates 45 are placed adjacent to each other to form a portion of the concrete receiving cavity 32, the upper portions 51 of four adjacent coffer plates 45 combining to form a raised area 58 which will subsequently form a void after the concrete has been poured. Assembly of this array of coffer plates 45 is accomplished by inserting the apertures 55 of the coffer plates 45 over the studs 28 of available pedestals 16 comprising the previously assembled network of pedestal feet 8 and pedestals 16. Each coffer plate 45 is then secured in position by an anchor nut 31 as previously described. Since the pedestal feet 8 and pedestals 16 preferably form a regular network, providing coffer plates 45 having a uniform size corresponding to the spacing developed between adjacent pedestals 16 provides a convenient means for assuring alignment of the assembled array of coffer plates 45 without requiring individual measurements or layouts. Attachment of the coffer plates 45 to the pedestals 16 proceeds in this manner, as needed, to form a mold for the structural element to be formed.

The coffer plates 46, 47, 48 are used to accomodate special needs, such as the formation of columns and outer edges of the structural element being formed. For example, use of a coffer plate 46 is illustrated at 59 to form an inner corner. Such coffer plates may also be used to form the perimeter of an uncoffered area, of the type used to accomodate a vertical column for example. Use of a coffer plate 47 is illustrated at 60 to develop a perimeter form such as is commonly provided along the periphery of a concrete element. Use of a coffer plate 48 is illustrated at 61 to form an outer corner of the structural element formed. Of course, the coffer plates 45, 46, 47, 48 may be combined in a variety of ways to form the waffle flat plate construction desired, the combination illustrated in FIG. 1 merely serving as an illustrative example.

Figure 9:
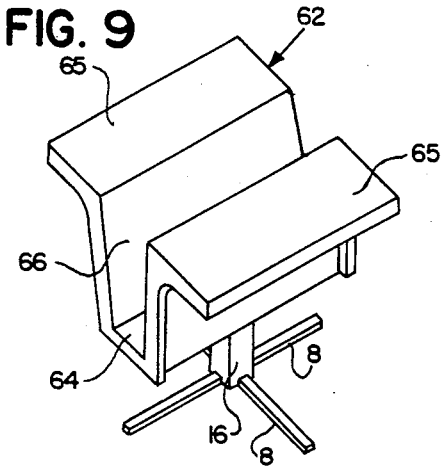
FIGS. 9 and 10 illustrate forms or coffer plates which can be used to form a beam or a one-way joist structural element.
Figure 10:
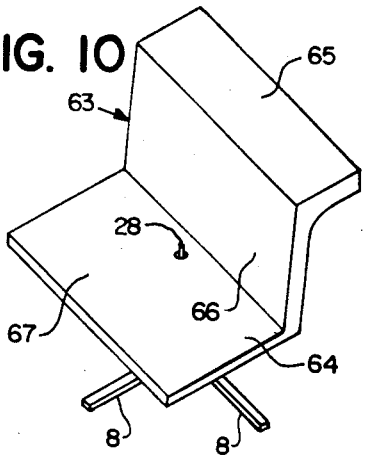

FIGS. 9 and 10 illustrate coffer plates 62, 63 which can be combined in various ways to form joists and beams in the structural element formed. As illustrated in FIG. 9, the coffer plate 62 includes a centrally disposed strip 64, either side of which is provided with a raised portion 65. Walls 66 are provided to connect the raised portions 65 and the strip 64 as shown. Clearly, the dimensional characteristics of the strip 64, the raised portions 65 and the walls 66 may be varied to suit a particular construction need. The coffer plate 63 illustrated in FIG. 10 includes features similar to that of the coffer plate illustrated in FIG. 9, however, only a single raised portion 65 is provided, as is a flat portion 67 which is substantially coextensive with the strip 64. As before, in each case, an aperture 55 is substantially centrally positioned along the strip 64, which aperture 55 is capable of engaging the stud 28 of a pedestal 16. An anchor nut 31 may then be used to retain the coffer plate 64 to the pedestal 16 as previously described.

Referring again to FIG. 1, use of the coffer plates 62, 63 to form a joist is illustrated. For example, use of the coffer plate 62 is illustrated at 68, while use of the coffer plate 63 is illustrated at 69. As may be seen in FIG. 1, a pair of coffer plates 63 may be positioned adjacent each other so that a concrete beam of substantial width is produced. Additional coffer plates 62, 63 may be placed adjacent to the coffer plates shown at positions 68, 69 to provide the joists and beams being formed with their desired length. Again, proper location of the coffer plates 62, 63 is facilitated by the regular network established by the pedestal feet 8 and pedestals 16 previously described.

Figure 11:
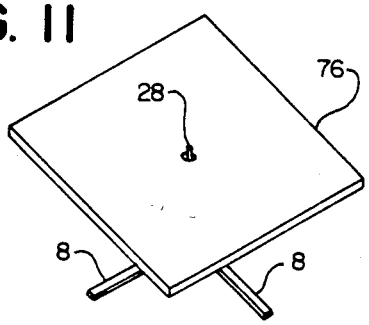
FIGS. 11 and 12 illustrate forms or coffer plates which can be used to form solid slab structural elements.
Figure 12:
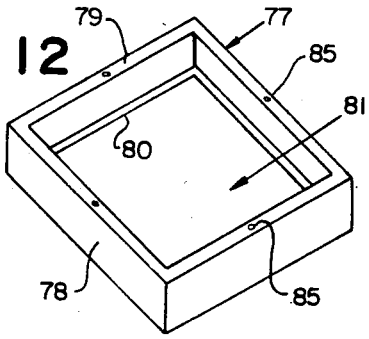

FIGS. 11 and 12 illustrate elements which may be combined in various ways to form a flat slab or flat plate structural form. Such elements may also be used to provide a structural element with areas of increased thickness at desired locations, to provide a selected portion of the structural element formed with additional structural integrity, or to properly interface the structural element formed with other portions of the building.

FIG. 11 illustrates a flat plate 76 having a centrally disposed aperture 55 which is capable of engaging the stud 28 of a pedestal 16 as previously described, using an anchor nut 31. FIG. 12 illustrates a skirt 77 which generally comprises a peripheral frame 78 having an upper flange 79 and a lower flange 80 which are preferably directed inwardly toward the centrally disposed cavity 81.

Figure 13:
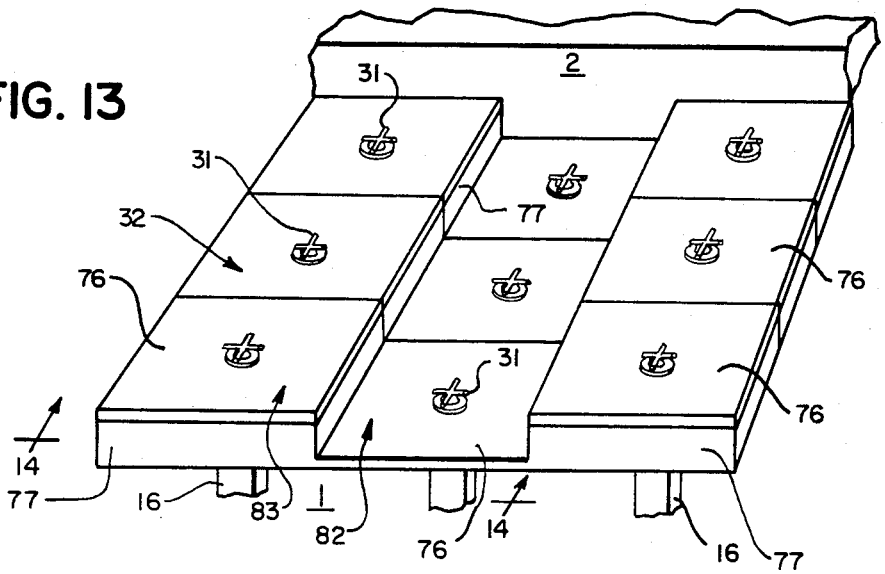
FIG. 13 is a partial, oblique view illustrating use of the system of the present invention to form a joist.

FIGS. 13 and 14 illustrate use of the flat plate 76 and skirt 77 to form a structural element. As shown, a plurality of plates 76, shown at 83, are positioned over a series of pedestals 16 to form a substantially flat surface. To form an area of increased thickness, shown at 82, a second series of plates 76 are positioned over a group of pedestals 16 which are shorter than those pedestals used to support the plates 76 forming the surface 83 in position. Since this would create spaces through which liquid concrete could flow when poured, a plurality of skirts 77 are attached beneath the plates 76 forming the surface 83 and adjacent to the plates 76 forming the surface 82, so that the frames 78 of the skirts 77 prevent the passage of concrete through this space. To facilitate attachment of the skirts 77 to the plates 76, the upper flange 79 is first preferably attached to the associated plate 76 using an appropriate fastener extending through apertures 85 provided in the upper flange 79. The assembled skirt and plate is then ready for placement over its associated pedestal 16, the cavity of the skirt 77 permitting the pedestal 16 to pass freely to the plate 76. After assembly of this concrete receiving form, the remainder of the construction process continues substantially as previously described.

It should be noted that in the illustrative embodiment shown in FIGS. 13 and 14, only portions of the peripheral skirt 77 illustrated in FIG. 12 are actually used as a concrete form. In such applications, partial skirts having semi-peripheral frame segments may be used in place of the skirts 77 previously described. Attachment of such partial skirts to their associated flat plates 76, in the proper orientation, would proceed substantially as previously described.

Many constructions call for the use of capital forms to create a reinforced interface between the structural element being formed and a column which supports it. FIG. 19 illustrates one manner in which such capital forms may be provided using the system 1 of the present invention. As shown, a capital form insert 106 is provided which, in the embodiment illustrated in FIG. 19, is capable of producing an inverted, truncated pyramid-shaped concrete form. The insert 106 therefore comprises four tapered surfaces 107, the upper ends of which terminate in a flange 108, and the lower ends of which combine to form an opening 109. Clearly, capital forms having other shapes may be produced as desired, such as frusto-conical shapes and the like, by suitably modifying this structure.

Use of the capital form insert 106 is illustrated in FIG. 19. First, adjacent coffer plates are cut to form an opening which is sized to correspond to the flange 108 of the insert 106, and which is located over the column which is to be engaged by the capital form. In this manner, any reinforcing rods extending from the column can be interconnected with those reinforcing rods which are to form part of the structural element being constructed. The insert 106 is then lowered into the opening so that the flange 108 is engaged by adjacent coffer plates 110 as shown. The flange 108 is then preferably directly attached to the coffer plates 110 using screws or other fasteners. Any reinforcing rods may then be placed as needed. Liquid concrete poured into the concrete receiving cavity 32 is then caused to flow within the capital form insert 106, creating the desired form. After curing, the insert 106 is left in position, as are the other coffer plates used to form the structural element.

It may therefore be seen from the foregoing that the system 1 of the present invention serves well to satisfy each of the objectives previously set forth. It may also be seen that this system may be varied to accomodate a variety of construction applications. In addition, a variety of additional components may be provided which enhance assembly of the system 1, and which accordingly make the system 1 easier and more economical to use.

Figure 15:
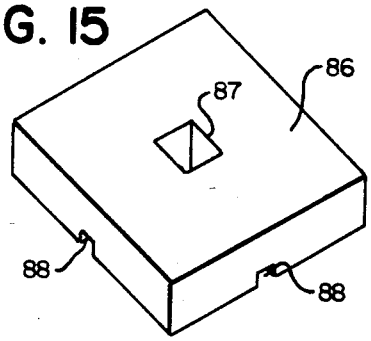
FIG. 15 is an axonometric view of a sealing or insulating unit which can be used in conjunction with the system of the present invention.

For example, in many applications it may become desirable to provide insulation between the structural element being formed and the rooms which are to be located beneath the structural element. To do so, insulation pads may be provided which cooperate with the elements comprising the system 1 to facilitate assembly. One such example is shown in FIG. 15, which illustrates an insulating pad 86 formed of an insulation material, such as fiberglass (spun glass) batts or semi-rigid blankets, and including a central core 87 configured to correspond to the peripheral shape of the pedestals 16. Such insulating pads 86 are readily placed in position over the pedestals 16 and pedestal feet 8 by placing the core 87 over a pedestal 16 and by wrapping the material forming the insulating pads 86 around any obstructions, including pipes, conduit, etc., as needed. The insulating pads 86 are preferably placed in position before the coffer plates are located over the pedestals 16. However, if desired, portions of the system 1 may later be disassembled to permit the pads 86 to be placed in position after the structural element has been formed. The latter operation may be accomplished for examle, by removing the screws 35 which retain the pedestal feet 8 to the pedestals 16, thereby detaching the pedestal feet 8 from the pedestals 16 and permitting access to the pedestals 16 from below. Reassembly of the system is easily accomplished by reversing these steps.

Generally, the insulating pads 86 will be formed of a material which is sufficiently pliable to easily wrap around relatively small obstructions, including the pedestal feet 8, and which can easily be cut or reshaped to fit around relatively large obstructions as needed. However, in some applications it may become necessary to use rigid foam insulation materials, to meet certain fire codes for example, which do not exhibit such pliability. In such cases, the indentations 88 illustrated in FIG. 15 may be provided. Such indentations 88 are configured to correspond to the shape of the pedestal feet 8 intersecting the pedestal 16 over which the insulating pad 86 is to be located. Accordingly, during installation, the indentations 88 may be aligned with the pedestal feet 8, properly aligning and seating the insulating pad 86 in position over the pedestal 16 and its associated pedestal feet 8.

Pads 86 formed of a solid, rigid plastic foam, or even cardboard, may also be used as solid inserts capable of providing a sealing function similar to that of the skirts 77. For example, in many applications large portions of a coffer plate must be removed to permit a column to transect or pass through to the structural element 2 being formed. In such cases, it often becomes necessary to form a dam against the flow of liquid concrete through the opening which has been provided in the coffer plates. Such openings are often sufficiently irregular to preclude use of the skirts 77 for this purpose. However, pads 86 formed of a solid, rigid material are well suited for such applications since they are readily cut and shaped with ordinary tools to conform to the shape reqired. Again, such pads 86 may be provided with or without indentations 88, as indicated.

Generally, the core 87 of the pad 86 is sized to frictionally engage the pedestal 16, so that the pad 86 may be directly applied to the pedestal 16 as desired. However, in some applications it may become desirable to assure that the pads 86 remain at the top of each pedestal 16. In such cases, a separate plate may be affixed to the top of the pad 86, over the core 87, which plate includes an aperture sized to engage the stud 28. In this manner, during assembly, the stud 28 will engage the aperture of the plate, urging the pad 86 upwardly and into intimate contact with the bottom of the coffer plate used. In such case, use of the indentations 88 may be omitted if desired.

Figure 16:
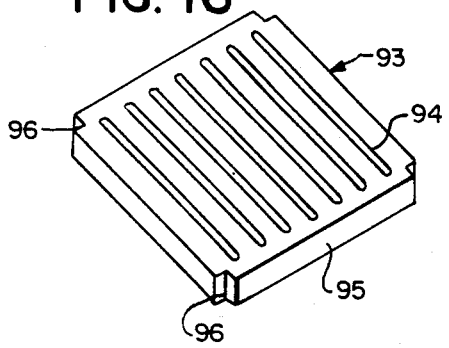
FIGS. 16 and 17 are axonometric views illustrating alternative embodiment modules which may be used to house electrical equipment.
Figure 17:
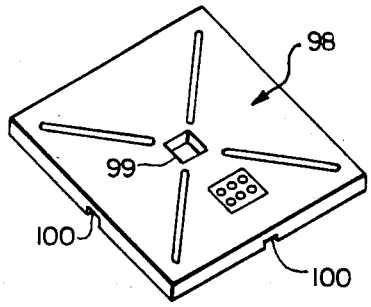

As a further consideration, it is often desirable to provide the building with electrical equipment such as lighting or heating. Electrical modules which may be used for this purpose are illustrated in FIGS. 16 and 17. The module 93 illustrated in FIG. 16 includes a flat central portion 94 and a peripheral, depending flange 95. Each of the corners 96 are notched as shown. Use of the module 93 is illustrated in FIG. 1, for example, at 97. As shown, the module 93 is maintained in position by locating the corners 96 between adjacent pedestals 16 so that the flange 95 rests on associated pedestal feet 8. This creates a housing which may be used to contain lighting fixtures, radiant heaters, or the like, as desired. FIG. 17 illustrates an alternative embodiment module 98 which includes a centrally disposed aperture 99 capable of engaging one of the pedestals 16, and a plurality of indentations 100 which are capable of engaging the pedestal feet 8. In use, the aperture 99 is engaged by a pedestal 16 while the indentations 100 are engaged by intersecting pedestal feet 8, maintaining the module 98 is position. Again, the module 98 may be used to house electrical fixtures as desired. Clearly, the modules 93, 98 serve as alternative embodiments which may be used, as needed, in conjunction with the system 1 of the present invention to produce a desired result. Similarly, the pads 86 previously described may be combined as needed to produce a desired result, it being understood that alternative embodiment pads 86 having the overall shape of the modules 93, 98 may be formed as well.

Another consideration is that the finished structure be provided with a proper ceiling for any rooms to be provided below. At present, suspended ceiling systems are often used for this purpose. Such systems generally comprise a plurality of channels which form an orthogonal network capable of receiving a plurality of finished ceiling panels. The channels are generally suspended from the structural element, again primarily by injecting powder-actuated fasteners into the formed element in the conventional manner. If desired, such ceiling systems may also be used in conjunction with the system 1 of the present invention. For example, a plurality of hangers capable of supporting the channels in position may be suspended from the apertures 13 of the pedestal feet 8, either by threadingly engaging threaded apertures, or using expandable fasteners to engage unthreaded apertures. After installing such hangers, the remainder of the ceiling may then be assembled in the conventional fashion.

As illustrated in FIG. 20 such ceiling systems may also be suspended from the pedestals 16. To do so, wire hangers 165 may be provided which include a bolt portion 166 capable of threadingly engaging the aperture 23 in the base 17 of each pedestal 16, and a wire portion 167 fixedly associated with the bolt portion 166 and which terminates at a hook 168. In use, the bolt portion 166 is inserted into the threaded aperture 23 of a pedestal 16, and the hook 168 is used as a support for the channels 169 of the suspended ceiling system. The ceiling panels 170 are then placed in position in the conventional manner. Clearly, the length of the wire portions 167 would be variable to accomodate different applications.

The system 1 of the present invention is also suited for use in conjunction with other ceiling systems, some of which can cooperate directly with the network of pedestals 16 and pedestal feet 8. For example, conventional flush mount/surface mount type ceilings may also be used with the system 1 of the present invention since the materials comprising such ceilings (e.g., drywall, plaster, linear metal, wood planks, and others) are readily directly attached to the pedestal feet 8 using the apertures 13. In some cases, it may be necessary to first apply furring strips to the pedestal feet 8 before the actual ceiling materials are applied.

FIG. 3 illustrates a ceiling system which is particularly adapted for use with the system 1 of the present invention. As ilustrated, each ceiling panel 101 includes a generally flat portion 102 and at least one, preferably two, depending channels 103 for engaging the pedestal feet 8 of the system 1. The channels 103 illustrated comprise a pair of walls 104 extending from the flat portion 102 and terminating at flanged ends 105 capable of securely engaging the pedestal feet 8. Assembly of such a ceiling is readily accomplished by causing the channels 103 to engage the pedestal feet 8, retaining the ceiling panels 101 in position. Clearly, any edges or obstructions to be encountered may be accomodated by appropriately cutting and shaping ceiling panels 101 as needed. In this manner, a finished ceiling can be assembled quickly and inexpensively. It is even possible for the ceiling panels 101 to be installed as the array of pedestals 16 and pedestal feet 8 are being assembled, prior to pouring the concrete. In this manner, after the concrete has cured and the falsework 3 has been removed, the resulting structural element 2 will already be provided with a finished ceiling, eliminating the need for subsequent finishing.

Clearly, the appearance and contour of the portions 102 of the ceiling panels 101 can be varied as desired. Special, preshaped ceiling panels may also be provided to accomodate known obstructions such as columns, air diffusers and other equipment. For example, as illustrated in FIG. 24, at least portions of the peripheral edge 171 of a ceiling member 101 may be provided with a channel 172 shaped to engage a corresponding bead 173 associated with a diffuser 174 or other similar structure. In this manner, ceiling members 101 having the channels 172 may be placed adjacent portions of the ceiling which are to be provided with fixtures, such as the modules 93, 98 previously described, so that a diffuser 174 may be attached directly to the ceiling panels 101, enclosing the fixtures being used. Lastly, although use of the channels 103 is preferred, other means for engaging components of the system 1 may be provided in substitution for the channels 103. For example, various clamps capable of engaging the pedestal feet 8, or even the pedestals 16 may be provided to accomplish this result. Other variations are also possible.

Another consideration is that the finished structure be well adapted for subsequent servicing after the construction has been completed. A variety of elements combine to provide this capability. For example, the modular ceilings previously described are easily removed to obtain access to components suspended between the structural element formed and the suspended ceiling. Once exposed any damaged components are easily removed, as are any damaged pedestal feet 8 or pedestals 16. For example, as previously described, the pedestal feet 8 are easily removed by removing the attachment screw 25 and detaching the tapered portion 10 from the pedestal 16. The pedestals 16 are easily removed from the structural element by rotating the pedestal 16, thereby disengaging the stud 28 from the anchor nut 31. Replacement of these components is accomplished by reversing the foregoing steps.

Generally, it is desirable to assure that the pedestals 16 do not rotate under normal conditions. To do so, the retaining flange 89 shown in FIGS. 2 and 3 is provided. The retaining flange 89 generally comprises a flat portion 90 which includes a depending inner portion and a series of apertures 91. In use, the flange 89 is secured to a coffer plate, through the apertures 91, using appropriate fasteners such as the screws 92. In doing so, care should be taken to properly align the edges of the flange 89 with the edges of the coffer plate, to assure a square assembly results. During assembly of the system 1, as a coffer plate is located over a pedestal 16, the flange 89 is positioned over the pylon portion 18 of the pedestal 16 so that the flange 89 engages the pedestal 16 as the aperture 55 of the coffer plate is engaged by the stud 28 associated with that pedestal 16. This serves to automatically align the coffer plate with respect to the pedestal. Use of the flange 89, although optional, is therefore preferred to facilitate proper alignment between the coffer plate and the pedestal 16 to which it is attached. Of course, this flange 89 would be appropriately disconnected in the event that removal of a pedestal 16 becomes necessary.

FIG. 22 illustrates different types of mounting hardware which may be used to properly position components suspended from the system 1 of the present invention, as well as to assist in obtaining access to and repairing these components subsequent to their installation. Each of the brackets illustrated may be mounted directly to the pedestal feet 8 or the pedestals 16 as desired, or may be spaced from these elements by a tower bracket 115. The tower bracket 115 generally includes two mutually perpendicular legs 116, 117, one of which is provided with a series of spaced apertures 118 and the other of which is provided with an elongated slot 119. In use, the slot 119 is advantageously attached to one of the apertures associated with the pedestal feet 8 or the pedestals 16 using conventional hardware, the leg 116 serving to provide a desired extension.

FIG. 22 also illustrates a plurality of brackets 120, 121, 122, 123, 124 which may be used in conjunction with the tower bracket 115, the pedestal feet 8, or the pedestals 16, as desired. For example, a C-shaped bracket 120 is provided having a C-shaped section 125 which is capable of engaging a component and a base 126 which facilitates attachment of the bracket 120 to the structure desired. A set screw 127 may be used in conjunction with the C-shaped portion 125 for added security if desired. A split bracket 121 is provided having two members 128, 129. Each of the members 128, 129 are complementary in shape, and include a terminating flange 130. The flanges 130 are used to receive attachment screws 132, serving to retain the members 128, 129 together. One of the members 128 is provided with a base 131 which facilitates attachment of the bracket 121 to the structure desired. A J-bracket 122 is provided having and upper portion 133 including a plurality of apertures 134, and a lower portion 135 which is provided with a reinforcing rib 136. A thumb screw 137 may also be provided to assist in retaining a component within the lower portion 135 of the bracket 122 if desired. A U-shaped bracket 123 is provided having an arcuate portion 138 for engaging a component, and terminating flanges 139 for attachment to the structure desired. Lastly, a multi-channelled bracket 124 is provided which includes a central portion 140 having a series of channels 141, and terminating flanges 142 for attachment to the structure desired. Clearly, each of these brackets may be used individually, or in combination; and a variety of other brackets may be developed for use in conjunction with the system 1 of the present invention.

As a further consideration, it may sometimes be desirable to utilize the system 1 of the present invention in conjunction with standard, blind coffers of the type which are presently used in various construction applications. FIG. 23 illustrates one manner in which the system 1 of the present invention may be used in conjunction with such blind coffers 145. As shown, a network of pedestal feet 8 and pedestals 16 is assembled as previously described, and a plurality of flat plates 76 are positioned over the pedestals 16, using the anchor nuts 31, to form a substantially planar array. In this manner, the flat plates 76 serve as a surface upon which the conventional, blind coffers 145 may be placed. As shown, such blind coffers are essentially inverted, tub-shaped elements capable of producing a void in the structural element being formed. In use, these blind coffers 145 are placed directly upon the flat plates 76 in a regular array which permits the access of concrete to the anchor nuts 31. Preferably, the coffers 145 are securely retained in position once placed upon the flat plates 76. In the preferred embodiment, this is accomplished by providing the blind coffers 145 and flat plates 76 with "Velcro" connectors 146. Although the use of such connectors is preferred to permit re-positioning of the blind coffers 145 if necessary, conventional construction grade adhesives may also be used if preferred. The remainder of the construction process proceeds substantially as previously described, producing a conventional waffle flat plate construction. Of course, it is also possible to use other types of blind coffers 145, or to form the blind coffers 145 of a material which may be cut and shaped (e.g., solid foam plastic or cardboard) as desired at the job site, to form other types of structural elements in similar fashion. For example, linear series of blind coffers placed in an abutting relation may be formed so that adjacent series develop a cavity capable of forming a one-way joist or beam. Other combinations are also clearly possible.

Figure 18:
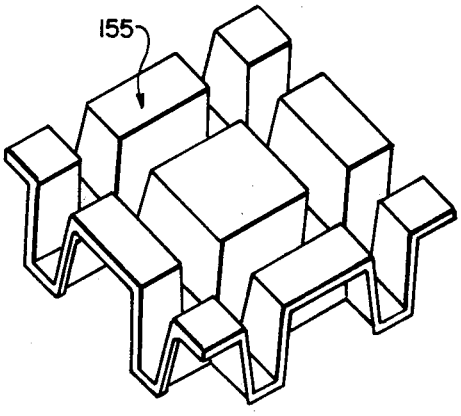
FIG. 18 is an axonometric view illustrating a combined, unitary coffer plate.

Lastly, special coffer plates may be developed in accordance with the present invention to satisfy particular construction needs. For example, in most applications it will become desirable to reduce the number of coffer plates which must be assembled to completely define the concrete receiving cavity. This may be accomplished by providing multiple element coffer plates rather than the individual coffer plates previously described. FIG. 18 illustrates one such multiple element coffer plate 155, which is based upon the coffer plate 45 illustrated in FIG. 5. As illustrated, the coffer plate 155 represents an integral combination of coffer plates 45 having the same essential characteristics as four juxtaposed, assembled coffer plates 45. Clearly, many variations of the illustrative example shown in FIG. 18 may be developed, and similar combinations may also be developed for the other types of coffer plates previously described.

Very often, the perimeter of the structural element being formed must be provided with a broadened portion or flange. FIG. 21 illustrates a perimeter form 150 which is adapted to provide both waffle flat plate and one-way joist constructions with such a flange. As illustrated, the perimeter form 150 is provided with a strip 50 and two raised portions 51 similar to those forming portions of the coffer plate 45 illustrated in FIG. 5. However, unlike the coffer plate 45 illustrated in FIG. 5, the base 49 of the perimeter form 150 extends outwardly and upwardly, forming a contoured portion 151. The contoured portion 151 illustrated extends fully across the width of the perimeter form 150, developing a cavity 152 capable of producing a flange or spandrel beam on the structural element being formed, and includes a variety of structural features which facilitate its use. For example, the broadened areas of the contoured portion 151 assist in resisting lateral pressures developed when liquid concrete is poured into the cavity 152. The outer face 153 of the contoured portion 151 provides an exposed spandrel surface which may either be pre-finished and left exposed after the structural element has been formed or which may be further prepared to receive additional finishing materials, still further reducing construction costs. Lastly, the terminating edge 154 of the contoured surface 151 serves as a convenient screed rail for leveling or screeding the concrete form. It should be noted that the perimeter form 150 illustrated in FIG. 21 is merely illustrative of various forms which may be used to develop a flange or spandrel beam on the structural element being formed, and that similar modifications may be made to the coffer plates 46, 47, 48 which are used to form a waffle flat plate construction; the coffer plates 62, 63 which are used to form beams and joists; and the plates 76 which are used to form flat plate and flat slab constructions as well. Clearly, other perimeter forms may be developed for use in conjunction with other construction applications.

It will be understood that various changes in the details, materials and arrangement of parts which have been herein described and illustrated in order to explain the nature of this invention may be made by those skilled in the art within the principle and scope of the invention as expressed in the following claims.

What is claimed is:

1. An apparatus for forming concrete structural elements comprising:

(a) falsework means for supporting the structural element in position during formation;

(b) a plurality of runners positioned on the falsework means to form an array;

(c) a plurality of supports engaging intersecting runners forming the array and extending from the array, each support further comprised of a base portion including a plurality of apertures and terminating in a pylon portion which defines a centrally disposed cavity and which terminates at an opening;

(d) a plurality of coffer plate means engaging the plurality of supports and combining to define a concrete receiving cavity; and (e) anchor means for securing the coffer plate means to the supports and including means for interacting with concrete used in forming the structural element;

so that concrete poured into the concrete receiving cavity fills the cavity defined by the coffer plate means and interacts with the anchor means so that, after the concrete has cured and the falsework means has been removed, finishing components are capable of being suspended from the array of runners and supports without altering the concrete comprising the structural element.

2. The apparatus of claim 1 further comprising reinforcing means positioned within the concrete receiving cavity.

3. The apparatus of claim 1 wherein each of the runners comprises a longitudinal segment and a mounting portion associated with at least one end of the longitudinal segment and including an aperture extending longitudinally therethrough.

4. The apparatus of claim 3 wherein the other end of the longitudinal segment of a first runner includes tenon means for engaging a slot formed in the other end of the longitudinal segment of a second runner positioned adjacent to the first runner.

5. The apparatus of claim 4 wherein the tenon means diverges from the other end of the longitudinal segment of the first runner and wherein the slot converges from the other end of the longitudinal segment of the second runner.

6. The apparatus of claim 7 wherein the other end of each longitudinal segment includes a slot, and wherein the apparatus further includes a joint means having a pair of opposed tenon means for engaging the slots.

7. The apparatus of claim 6 wherein the tenon means forming the joint means diverge from the center of the joint means, and wherein the slots converge toward the end of the longitudinal segments.

8. The apparatus of claim 5 or 7 further comprising means for securing the tenon means of the first runner within the slot of the second runner.

9. The apparatus of claim 1 wherein the opening of the pylon portion is enclosed by a plate attached to the pylon portion and including a substantially centrally disposed stud means extending therefrom.

10. The apparatus of claim 1 wherein at least some of the apertures of the base portion provide a means for engaging a mounting portion associated with the runners.

11. The apparatus of claim 10 wherein the mounting portion includes a longitudinal aperture extending therethrough, and further comprising attachment means extending through the aperture of the mounting portion to an aperture associated with the mounting portion engaging means of the base portion.

12. The apparatus of claim 11 wherein the mounting portion of the runner and the engaging means of the base portion are correspondingly tapered.

13. The apparatus of claim 1 wherein other of said apertures extend through the base portion to the cavity defined by the pylon portion.

14. The apparatus of claim 1 further comprising a retaining flange including a mounting portion having a centrally disposed opening terminating at a depending flange and a series of apertures extending through the mounting portion.

15. The apparatus of claim 14 wherein the flange is dimensioned to slidingly engage the pylon portion of the support, and wherein the coffer plate means are capable of being engaged by mounting means extending through the apertures of the mounting portion, thereby preventing respective rotation between the support and the coffer plate means with which it is associated.

16. The apparatus of claim 1 wherein the anchor means comprises a core portion for engaging the support with which the anchor means is associated; bearing means associated with a terminating end of the core and capable of bearing against the coffer plate means which is secured to the associated support; and substantially radially disposed flange means extending outwardly from the core and defining a concrete receiving area between the flange means and the bearing means.

17. The apparatus of claim 1 wherein the coffer plate means comprises a substantially flat plate including a substantially centrally disposed aperture extending therethrough and adapted for engagement by portions of an associated support.

18. The apparatus of claim 17 wherein at least one corner of the coffer plate means includes a raised portion having a substantially flat upper portion and wall means extending between the upper portion and the flat plate.

19. The apparatus of claim 18 having four raised portions, one at each corner thereof.

20. The apparatus of claim 18 wherein the coffer plate means includes a base portion which terminates at the wall means and which includes the aperture which extends through the coffer plate means.

21. The apparatus of claim 20 wherein the base portion is defined by two intersecting strips extending between opposing edges of the coffer plate means.

22. The apparatus of claim 17 wherein a least one side of the coffer plate means includes a raised portion having a substantially flat upper portion and wall means extending between the upper portion and the flat plate.

23. The apparatus of claim 22 having two raised portions separated by a strip extending between opposing sides of the coffer plate means and defining a base portion.

24. The apparatus of claim 17 wherein edge portions of the coffer plate means are provided with pile strip means.

25. The apparatus of claim 17 further comprising skirt means attached to and depending from the coffer plate means.

26. The apparatus of claim 25 wherein the skirt means comprises a frame portion terminating in at least one flange having apertures extending therethrough and capable of receiving means for attaching the flange of the skirt means to the coffer plate means.

27. The apparatus of claim 17 wherein the coffer plate means is formed of a composite wood fiber material comprising wood fibers disposed in a resinous or cementitious matrix and molded under high pressure.

28. The apparatus of claim 24 wherein portions of the coffer plate means are covered with sheet metal.

29. The apparatus of claim 17 wherein at least one side of the coffer plate means includes perimeter form means extending upwardly from terminating edge portions thereof.

30. An apparatus for forming concrete structural elements comprising:

(a) a falsework means for supporting the structural element in position during formation;

(b) a plurality of runners positioned on the falsework means to form an array;

(c) a plurality of supports engaging intersecting runners forming the array and extending from the array;

(d) a plurality of substantially flat plates engaging the plurality of supports and combining to form at least two groups, located in different planes, and wherein spaces developed between the flat planes located in one plane and the flat plates located in an other plane are enclosed by a plurality of skirt means comprising a peripheral frame terminating in at least one flange having apertures extending therethrough and capable of receiving means for attaching the flange of the skirt means to be selected flat plates adjacent the spaces to be enclosed; and (e) anchor means for securing the flat plates to the supports and including means for interacting with concrete used in forming the structural element;

so that concrete poured over the concrete receiving surface forms the structural element and interacts with the anchor means so that, after the concrete has cured and the falsework means has been removed, finishing components are capable of being suspended from the array of runners and supports without altering the concrete comprising the structural element.

31. The apparatus of claim 30 further comprising a plurality of blind coffers adhered to the flat plates and located between adjacent anchor means.

32. An apparatus for forming concrete structural elements comprising:

(a) falsework means for supporting the structural element in position during formation;

(b) a plurality of runners positioned on the falsework means to form an array;

(c) a plurality of supports engaging intersecting runners forming the array and extending from the array, each support further comprised of a base portion including a plurality of apertures and terminating in a pylon portion which defines a centrally disposed cavity and which terminates at an opening;

(d) a plurality of substantially flat plates engaging the plurality of supports and combining to define a concrete receiving surface; and (e) anchor means for securing the flat plates to the supports and including means for interacting with concrete used in forming the structural element;

whereby concrete poured over the concrete receiving surface forms the structural element.

33. An apparatus for forming concrete structural elements comprising:

(a) falsework means for supporting the structural element in position during formation;

(b) a plurality of runners positioned on the falsework means to form an array;

(c) a plurality of supports engaging intersecting runners forming the array and extending from the array;

(d) a plurality of substantially flat plates engaging the plurality of supports and combining to form at least two groups, located in different planes, and wherein spaces developed between the flat plates located in one plane and the flat plates located in an other plane are enclosed by a plurality of skirt means comprising a peripheral frame terminating in at least one flange having apertures extending therethrough and capable of receiving means for attaching the flange of the skirt means to selected flat plates adjacent the spaces to be enclosed; and (e) anchor means for securing the flat plates to the supports and including means for interacting with concrete used in forming the structural element;

so that concrete poured ocver the concrete receiving surface forms the structural element.

34. An apparatus for forming concrete structural elements comprising:

(a) falsework means for supporting the structural element in position during formation;

(b) a plurality of runners positioned on the falsework means to form an array;

(c) a plurality of supports engaging intersecting runners forming the array and extending from the array, each of the runners comprises a longitudinal segment including a plurality of spaced apertures extending therethrough and a mounting portion associated with at least one end of the longitudinal segment and including an aperture extending therethrough, the other end of alternate runners having a longitudinal segment which includes at the other end thereof a tenon means for engaging a slot formed in the other end of a longitudinal segment of a second alternate runner positioned adjacent to the first runner;

(d) a plurality of substantially flat plates engaging the plurality of supports and combining to define a concrete receiving surface; and (e) anchor means for securing the flat plates to the supports and including means for interacting with concrete used in forming the structural element;

so that concrete poured over the concrete receiving surface forms the structural element.

35. The apparatus of claim 34 wherein the tenon means diverges from the other end of the longitudinal segment of the first runner and wherein the slot converges from the other end of the longitudinal segment of the second runner.

36. The apparatus of claim 35 further comprising means for securing the tenon means of the first runner with the slot of the second runner.

37. The apparatus of claim 35 wherein the other end of each longitudinal segment includes a slot, and wherein the apparatus further includes a joint means having a pair of opposed tenon means for engaging the slots.

38. The apparatus of claim 37 wherein the tenon means forming the joint means diverge from the center of the joint means, and wherein the slots converge toward the end of the longitudinal segments.

39. The apparatus of claim 38 further comprising means for securing the tenon means of the first runner within the slot of the second runner.

* * * * *